US012304691B1

(12) United States Patent
Breeden et al.

(10) Patent No.: US 12,304,691 B1
(45) Date of Patent: May 20, 2025

(54) FOOD TRAY

(71) Applicant: Pressed Paperboard Technologies, LLC, Bingham Farms, MI (US)

(72) Inventors: Adam J. Breeden, Findlay, OH (US); Michael A. Weithman, Perrysburg, OH (US); Mark A. Poe, Findlay, OH (US); Jason A. Caudill, Findlay, OH (US)

(73) Assignee: Pressed Paperboard Technologies, LLC, Bingham Farms, MI (US)

( * ) Notice: Subject to any disclaimer, the term of this patent is extended or adjusted under 35 U.S.C. 154(b) by 0 days.

(21) Appl. No.: 18/386,891

(22) Filed: Nov. 3, 2023

(51) Int. Cl.

| | |
|---|---|
| ***B65D 1/34*** | (2006.01) |
| ***A47G 19/02*** | (2006.01) |
| ***A47G 19/03*** | (2006.01) |
| ***B65D 1/40*** | (2006.01) |
| ***B65D 1/42*** | (2006.01) |

(52) U.S. Cl.
CPC ..... *B65D 1/42* (2013.01); *B65D 1/34* (2013.01); *A47G 19/02* (2013.01); *A47G 19/03* (2013.01)

(58) Field of Classification Search
CPC .. B65D 1/42; B65D 1/34; B65D 2543/00648; B65D 2543/00537; A47G 19/02; A47G 19/03
USPC ..... 206/557, 518; 220/657, 659, 669; 229/406, 407, 574
See application file for complete search history.

(56) References Cited

U.S. PATENT DOCUMENTS 1,748,865 A * 2/1930 Chaplin ..... D21J 3/00 220/574
1,866,035 A * 7/1932 Hart ..... A47G 19/02 220/574
2,348,725 A * 5/1944 Chaplin ..... B65D 1/34 229/406
2,814,427 A * 11/1957 Emery ..... B65D 1/34 D11/155
3,268,144 A * 8/1966 Gaunt ..... B65D 1/42 229/406
3,792,809 A * 2/1974 Schneider ..... A47G 19/03 229/930
4,606,496 A * 8/1986 Marx ..... B65D 1/34 229/5.8
4,609,140 A * 9/1986 Van Handel ..... A47G 19/03 229/5.8
4,721,499 A * 1/1988 Marx ..... B65D 1/34 264/324
4,742,934 A * 5/1988 Michaud ..... B65D 43/0212 220/784
5,088,640 A * 2/1992 Littlejohn ..... A47G 19/03 220/574
5,326,020 A 7/1994 Cheshire et al.
5,676,276 A * 10/1997 Zielinski ..... A47G 23/06 220/574
5,938,112 A * 8/1999 Sandstrom ..... D21H 21/16 229/407

(Continued)

*Primary Examiner* — Gideon R Weinerth
(74) *Attorney, Agent, or Firm* — Quarles & Brady LLP

(57) ABSTRACT

A food tray includes a base wall, side walls, an outer rim, and a fillet. The side walls extend upward and outward from an outer region of the base wall along arcs having a first radius. The outer rim extends outward from upper regions of the side walls. The fillet separates the outer rim from the side walls. The fillet has a second radius. The first radius is greater than the second radius. The food tray may be used to store meat (e.g., beef, chicken, pork, etc.).

20 Claims, 7 Drawing Sheets

(56) References Cited

U.S. PATENT DOCUMENTS 6,474,497 B1 * 11/2002 Littlejohn ..... A47G 19/03 220/675
6,695,138 B1 2/2004 Colombo et al.
6,715,630 B2 4/2004 Littlejohn et al.
7,395,923 B2 * 7/2008 Chou ..... B65D 81/262 206/557
7,540,833 B2 6/2009 Johns et al.
7,552,840 B2 6/2009 Gitschlag et al.
8,177,119 B2 5/2012 Littlejohn
8,584,929 B2 * 11/2013 Littlejohn ..... B65D 43/0212 220/574
8,684,260 B2 4/2014 White et al.
9,538,870 B2 1/2017 Littlejohn et al.
9,555,916 B2 1/2017 Abayhan et al.
9,655,461 B2 * 5/2017 Littlejohn ..... A47G 19/03
9,757,886 B2 9/2017 Middleton et al.
RE47,165 E * 12/2018 Littlejohn ..... B65D 1/34
10,647,467 B1 * 5/2020 Tibbets ..... B31F 1/0038
11,535,417 B2 12/2022 Tibbets
11,649,103 B2 * 5/2023 Morrow ..... B65D 81/262 206/561
12,016,474 B2 * 6/2024 Berg ..... B65D 1/34
2002/0113118 A1 * 8/2002 Littlejohn ..... A47G 19/03 229/407
2003/0173366 A1 * 9/2003 Littlejohn ..... A47G 19/03 220/574
2006/0208054 A1 * 9/2006 Littlejohn ..... B65D 43/0212 229/406
2007/0235514 A1 * 10/2007 Abayhan ..... A47G 19/03 229/407
2010/0264202 A1 * 10/2010 Littlejohn ..... B65D 1/34 229/406
2017/0065110 A1 * 3/2017 Littlejohn ..... A47G 19/03
2017/0112304 A1 4/2017 Littlejohn et al.
2017/0217654 A1 * 8/2017 Harmon ..... B65D 65/466
2020/0002047 A1 * 1/2020 Starnes ..... B65D 1/34
2021/0114789 A1 * 4/2021 Kuiper ..... B29C 70/88
2023/0011217 A1 * 1/2023 Berg ..... B65D 1/34
2023/0135314 A1 * 5/2023 Bontrager ..... B65D 1/34 206/506
2023/0286719 A1 * 9/2023 Mack ..... B65D 1/42

* cited by examiner

FOOD TRAY

TECHNICAL FIELD

The present disclosure relates to food trays for containing food (e.g., meats or produce), and in some embodiments, food trays having flange geometries with beneficial structural support.

BACKGROUND

Food trays have been developed for storing food and for presenting the food to consumers. For instance, food trays used to store meat (e.g., beef, chicken, pork, etc.) have been proposed. These food trays may include a clear wrap (e.g., plastic wrap) covering the contents of the food tray. The clear wrap may seal or mate at an outer perimeter region of the food tray. Providing adequate strength to the outer perimeter region and designing an outer perimeter region that does not interfere with the sealing/mating of the clear wrap remain challenges.

SUMMARY

A food tray includes a base wall, side walls, and an outer rim. The side walls extend upward from an outer peripheral region of the base wall. The outer rim extends outward from upper regions of the side walls. The outer rim has a flat region extending upward and outward from the upper regions of the side walls.

A food tray includes a base wall, side walls, an outer rim, and a fillet. The side walls extend upward and outward from an outer region of the base wall along arcs having a first radius. The outer rim extends outward from upper regions of the side walls. The fillet separates the outer rim from the side walls. The fillet has a second radius. The first radius is greater than the second radius.

A food container includes a base, side panels, an outer rim, and a fillet. The side panels extend upward and outward from an outer region of the base along arcs having a first radius. A food storage space is defined between the side panels and above the base. An opening to the food storage space is defined along upper ends of the side panels. The outer rim extends radially outward from the upper ends of the side panels. The outer rim has a first flat panel extending radially outward from the upper ends of the side panels. The outer rim has a second flat panel extending downward from the first flat panel on an opposing side of the first flat panel relative to the upper ends of the side panels. The fillet is disposed between the first flat panel and the side panels. The fillet has a second radius. The first radius is greater than the second radius.

DETAILED DESCRIPTION

Figure 1:
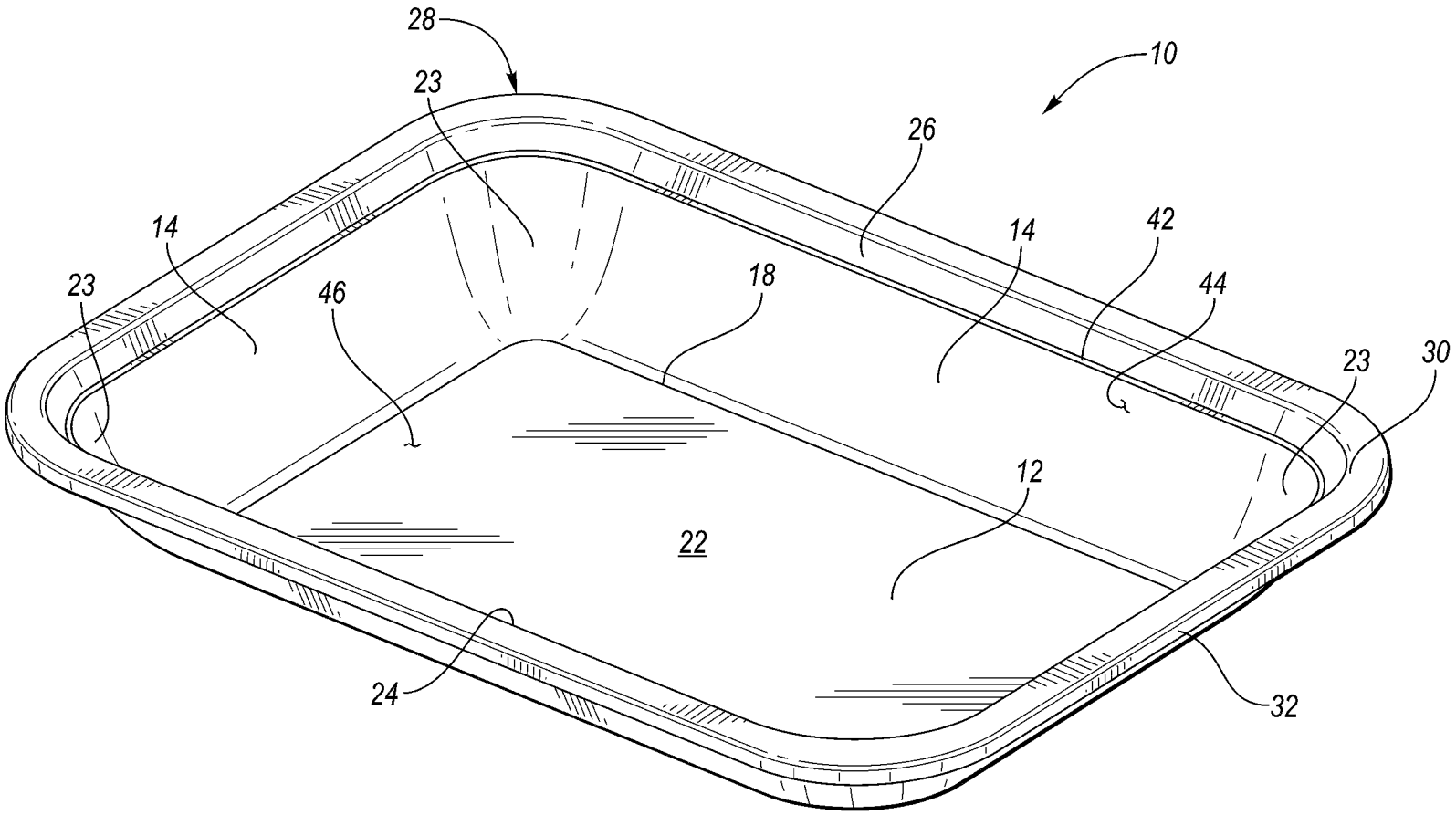
FIG. 1 is a top perspective view of a first embodiment of a food tray.
Figure 3:
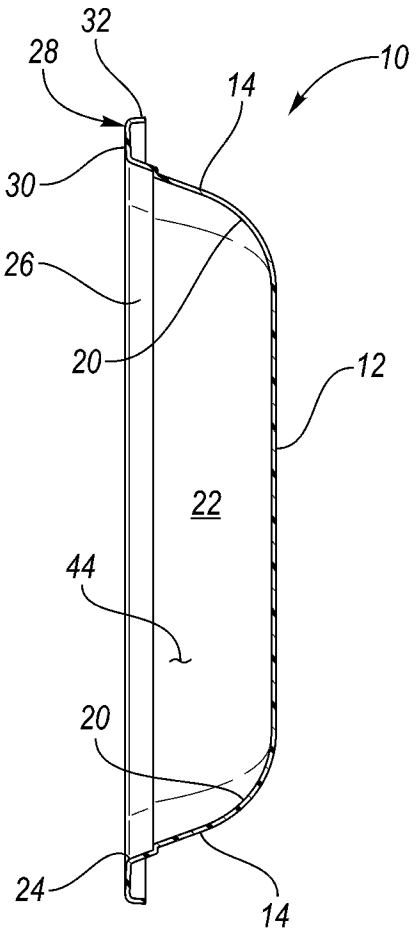
FIG. 3 is a cross-sectional view of the first embodiment of the food tray taken along line 3-3 in FIG. 2.
Figure 2:
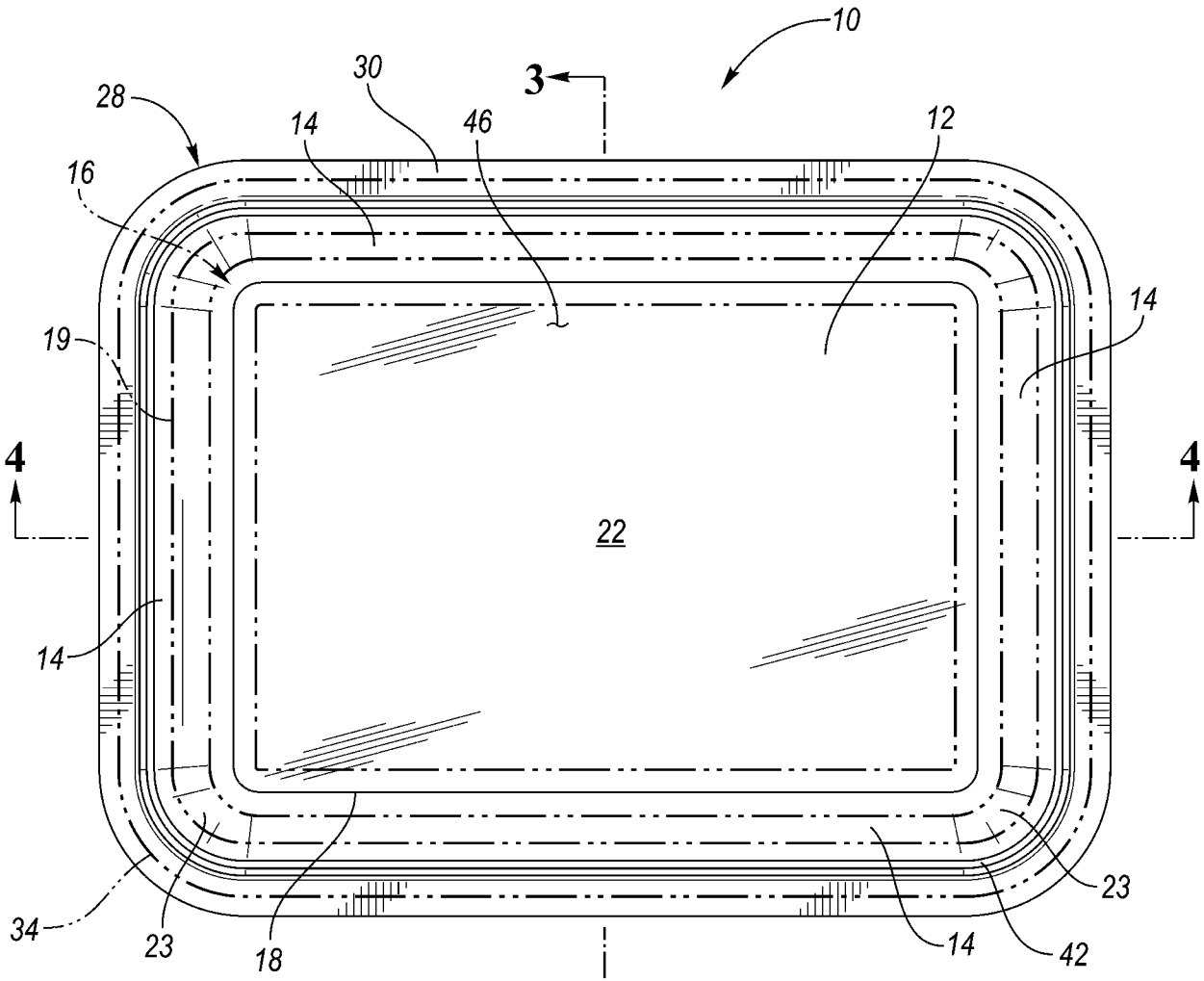
FIG. 2 is a top view of the first embodiment of the food tray.
Figure 4:
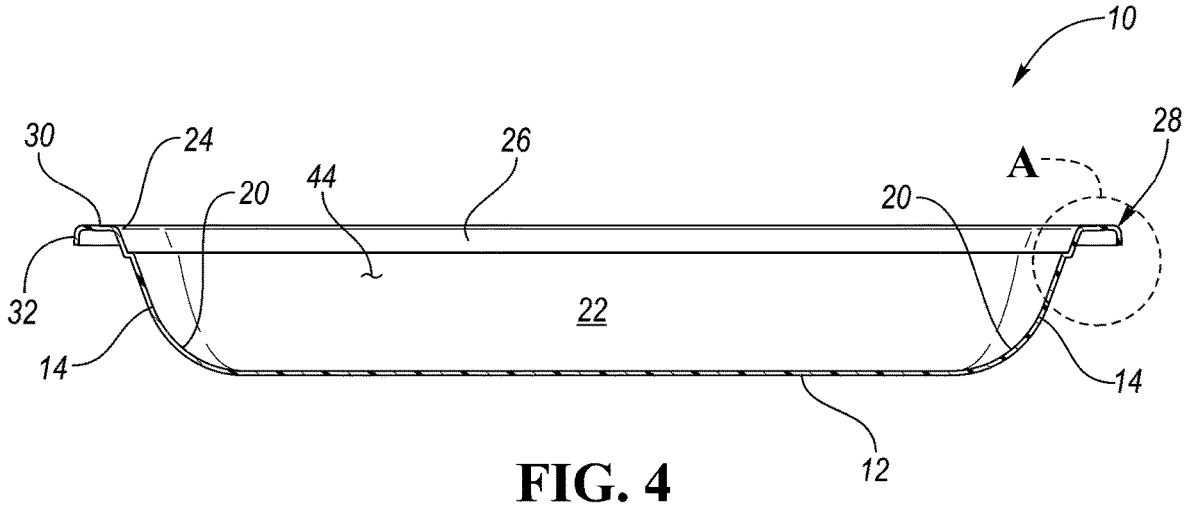
FIG. 4 is a cross-sectional view of the first embodiment of the food tray taken along line 4-4 in FIG. 2.
Figure 5:
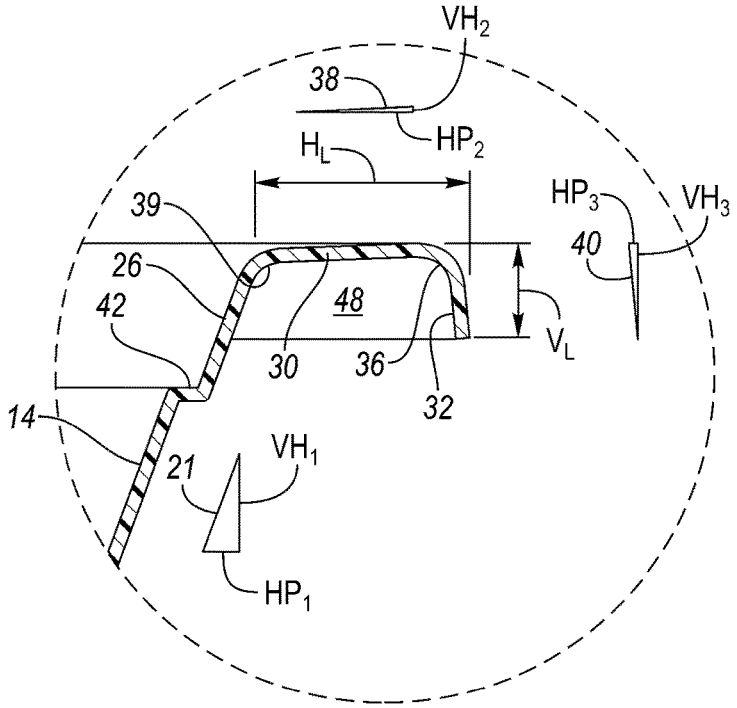
FIG. 5 is a magnified view of area A in FIG. 4.
Figure 6:
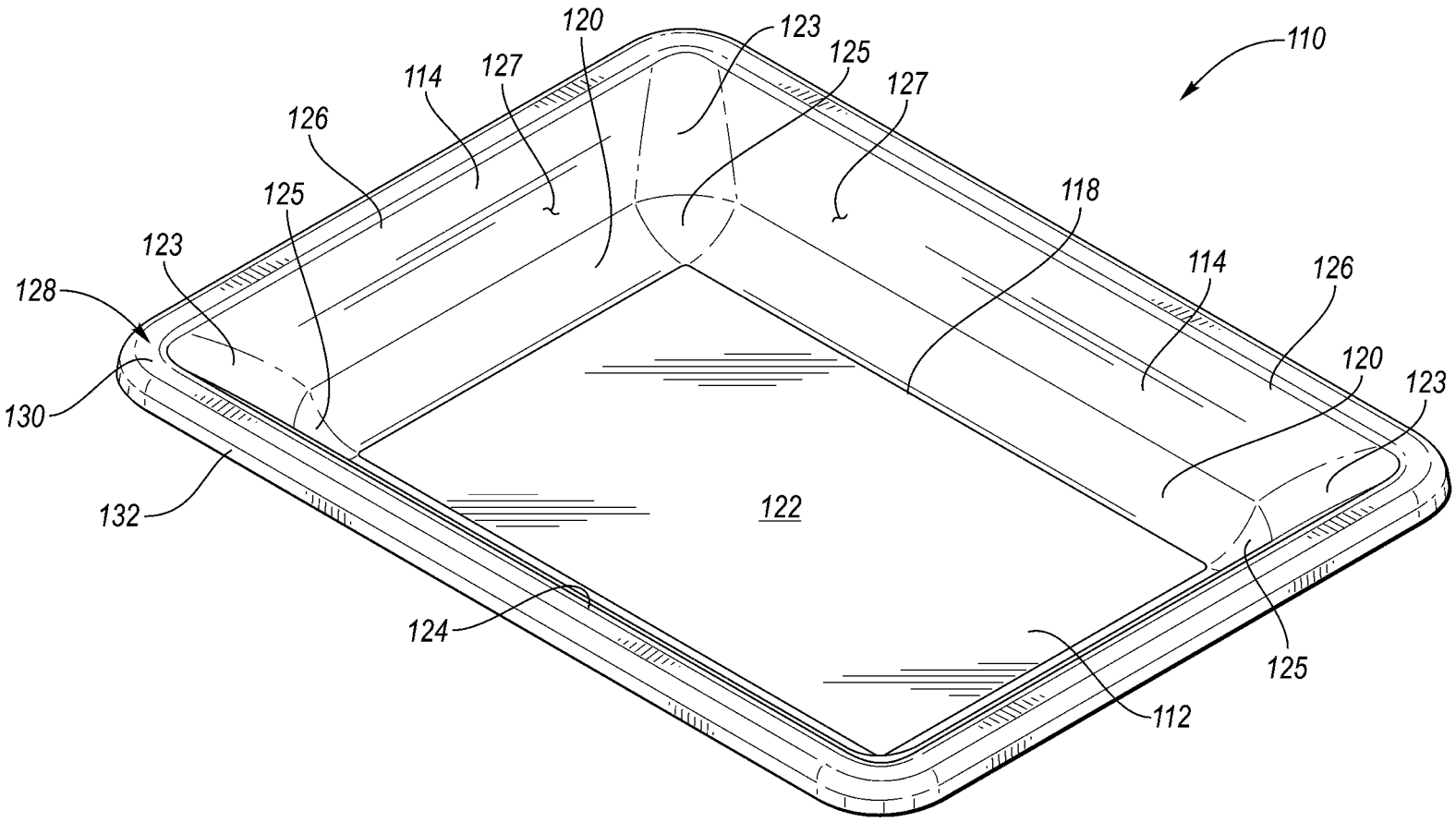
FIG. 6 is a top perspective view of a second embodiment of a food tray.
Figure 8:
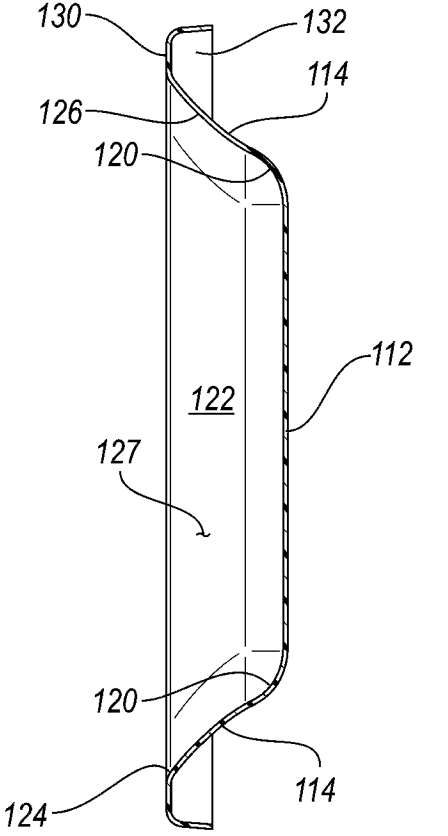
FIG. 8 is a cross-sectional view of the second embodiment of the food tray taken along line 8-8 in FIG. 7.
Figure 7:
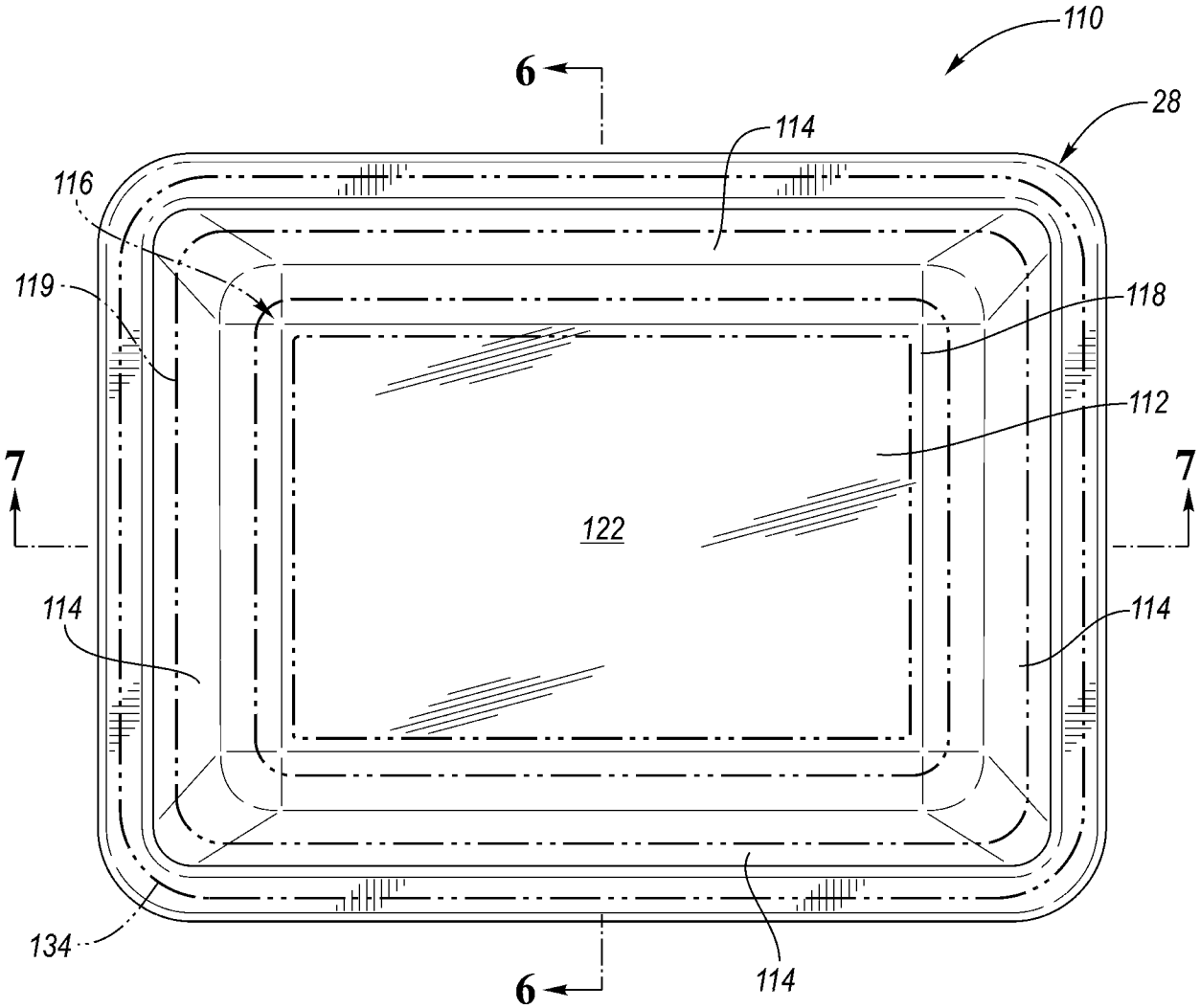
FIG. 7 is a top view of the second embodiment of the food tray.
Figure 9:
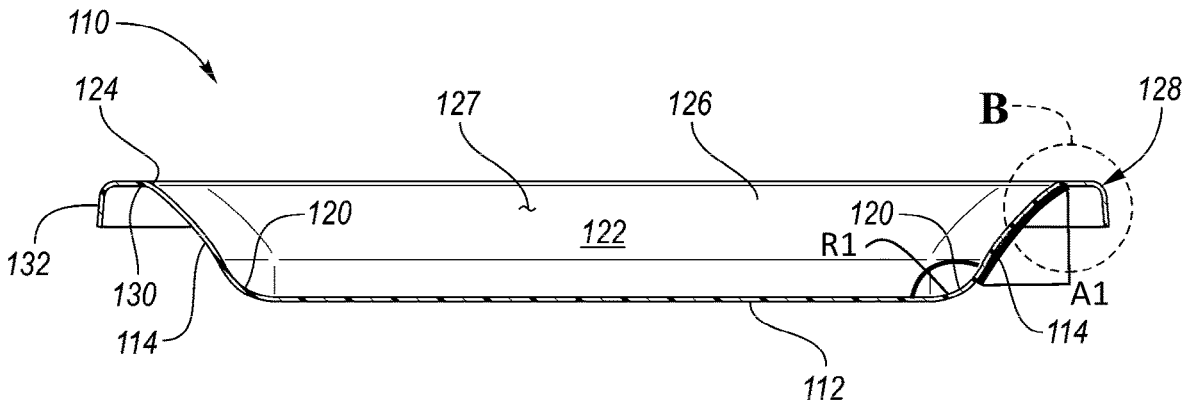
FIG. 9 is a cross-sectional view of the second embodiment of the food tray taken along line 9-9 in FIG. 7.
Figure 10:
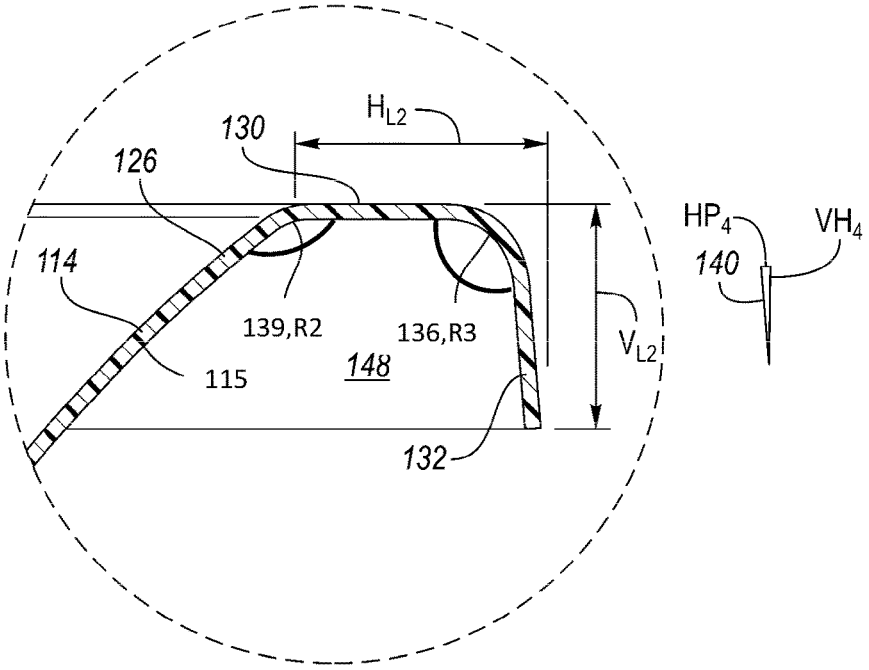
FIG. 10 is a magnified view of area B in FIG. 9.

Embodiments of the present disclosure are described herein. It is to be understood, however, that the disclosed embodiments are merely examples and other embodiments may take various and alternative forms. The figures are not necessarily to scale; some features could be exaggerated or minimized to show details of particular components. Therefore, specific structural and functional details disclosed herein are not to be interpreted as limiting, but merely as a representative basis for teaching one skilled in the art to variously employ the embodiments. As those of ordinary skill in the art will understand, various features illustrated and described with reference to any one of the figures may be combined with features illustrated in one or more other figures to produce embodiments that are not explicitly illustrated or described. The combinations of features illustrated provide representative embodiments for typical applications. Various combinations and modifications of the features consistent with the teachings of this disclosure, however, could be desired for particular applications or implementations.

Referring to FIGS. 1-5, a first embodiment of a food tray 10 and the corresponding structure of the food tray 10 are illustrated. The food tray 10 may be simply referred to as a tray. The food tray 10 may be constructed of a paperboard layer. Paperboard may refer to a fibrous material that can come from fresh, virgin sources, such as, wood, or from recycled wastepaper. Virgin paper may be made from a high content of wood pulp, for example, 90% wood pulp. The thickness of the paperboard layer may be any of the following values or within an inclusive range between any two of the following values: 0.006 inches, 0.012 inches, 0.018 inches, and 0.024 inches. Any range set forth herein may be an inclusive range.

The inner surface of the food tray 10 may be coated with a polyethylene (PE) resin or a poly substitute. The outer surface of the food tray 10 may be uncoated. The food tray 10 may be sized to contain food (e.g., poultry, beef, fish, produce, etc.). The thickness of the coating layer may be any of the following values or within an inclusive range between any two of the following values: 0.0001 inches, 0.00402 inches, 0.0004 inches, and 0.001 inches.

The food tray 10 may also operate as a food container, and therefore may be referred to as the food container or simply as the container. The food tray 10 may be configured to receive and store items, such as food. The food tray 10 may also be configured to contain and present such items for consumption (e.g., the food tray 10 may have an open top end that contains and/or presents food for transfer onto a plate). The food tray 10 may be configured to engage a cover or lid (not shown), which covers the open top end, when being utilized as a container for storage purposes. Such a cover or lid may be removed to expose the open top end to present the food items for dispensation. The cover or lid may be formed of a clear wrap (e.g., a clear plastic wrap).

The food tray 10 includes a base plate 12. The base plate 12 may be simply referred to as the base. Alternatively, the base plate 12 may be referred to as the base wall or the base panel. The base plate 12 is configured to support food items that are disposed on the food tray 10 along the bottom end of the food tray 10. The food tray 10 includes side walls 14 that extend upward from the base plate 12. The side walls 14 may simply be referred to as the sides. Alternatively, the side walls 14 may be referred to as the side panels. The side walls 14 may extend upward from an outer region or an outer peripheral region 16 of the base plate 12. The side walls 14 may more specifically extend upward from an outer periphery 18 of the base plate 12. The side walls 14 may comprise a single wall that forms a first closed loop 19 that encircles, encompasses, or extends around the base plate 12.

A rounded region or fillet 20 may be positioned between the base plate and the side walls 14. Additional rounded regions or fillets 23 may be positioned between adjacent side walls 14. The rounded regions or fillets 23 may taper as they extend down and toward the base plate 12. Rounded region or fillet 20 and rounded regions or fillets 23 may be concave when viewed internally within a food storage space 22 defined by the food tray 10. Rounded region or fillet 20 and rounded regions or fillets 23 may be convex when viewed externally from an exterior of the food tray 10.

The side walls 14 may extend upward and radially outward from the base plate 12. The base plate 12 may be oriented horizontally and the side walls 14 may extend upward and outward from the base plate 12 at a slope 21 that is greater than 0.5 (e.g., at an angle that is 25° or greater from a horizontal plane or from the base plate 12). In some examples, the slope 21 can be greater than 1 (e.g., at an angle that is 45° or greater from a horizontal plane or from the base plate 12). Slope 21 may refer to a ratio in a change in vertical height $VH_1$ from a horizontal plane or from the base plate 12 over a corresponding change in a horizontal position $HP_1$ (e.g., slope 21=$VH_1/HP_1$).

In one or more embodiments, the side walls 14 may extend upward and outward from the base plate at a slope 21 that ranges between 0.5 (e.g., at an angle that is 25° or approximately 25° from a horizontal plane or from the base plate 12, or that is 25° or approximately 25° from a vertical plane) and 11 (e.g., at an angle that is 85° or approximately is 85° from a horizontal plane or from the base plate 12, or that is 5° or approximately 5° from a vertical plane), inclusive. In some examples, the slope 21 can range between 1 (e.g., at an angle that is 45° or approximately 45° from a horizontal plane or from the base plate 12, or that is 45° or approximately 45° from a vertical plane) and 11 (e.g., at an angle that is 85° or approximately is 85° from a horizontal plane or from the base plate 12, or that is 5° or approximately 5° from a vertical plane), inclusive. Unless otherwise specified or limited, the terms 'about' and 'approximately,' as used herein with respect to a reference value, refer to variations from the reference value of ±20% or less (e.g., ±15, ±10%, ±5%, etc.), inclusive of the endpoints of the range.

The base plate 12 may be substantially flat. As used herein, substantially flat refers to a flat surface that has no deviations from a perfectly flat plane or has deviations from the perfectly flat plane that are less than a tolerance of 3 millimeters (mm). For example, the base plate 12 may have an allowable tolerance of 3 mm or less, 2 mm or less, 1 mm or less, or 0.5 mm or less, 0.25 mm or less, etc. from a corresponding perfectly flat plane. As used herein, "flat" may indicate a planar feature or a substantially flat feature. As used herein, "substantially flat" refers to a feature that deviates from a reference plane by less than a tolerance of 2 millimeters (mm).

The side walls 14 may be configured to prevent items, such as food items, from slipping or falling off the base plate 12. Stated in other terms, the side walls 14 may be configured to retain items, such as food items, on the base plate 12. The food storage space 22 is defined between the side walls 14 and above the base plate 12. An opening 24 to the food storage space 22 is defined along upper ends or upper regions 26 of the side walls 14. The opening 24 may be covered by a lid (not shown) when the food tray 10 is being utilized as a storage container.

The food tray 10 includes an outer rim 28 that extends outward from the side walls 14. The outer rim 28 may be referred to as an overhanging region or an overhang that extends radially outward from the side walls 14. The outer rim 28 may extend radially outward from the upper ends or the upper regions 26 of the side walls 14. The outer rim 28 has a first flat region 30 that extends upward and outward from the upper ends or the upper regions 26 of the side walls 14. The outer rim 28 also has a second flat region 32 that extends downward and outward from the first flat region 30 on an opposing side of the first flat region 30 relative to the upper ends or the upper regions 26 of the side walls 14. The outer rim 28 may form a second closed loop 34 that encircles, encompasses, or extends around the side walls 14 and the base plate 12.

The first flat region 30 may comprise a first flat panel extending upward and radially outward from the upper ends or the upper regions 26 of the side walls 14, while the second flat region 32 may comprise a second flat panel extending downward and radially outward from the first flat panel. The first flat panel may be an upper panel and may be substantially flat. The second flat panel may be a side panel and may also be substantially flat.

The outer rim 28 may further comprise a rounded region or fillet 36. The first flat region 30 may be separated from the second flat region 32 by the rounded region or fillet 36. The first flat region 30 may extend upward and outward from the upper ends or the upper regions 26 of the side walls 14 at a slope 38 relative to the horizontal or relative to the base plate 12 that is less than one (e.g., at an angle that is 45° or less from a horizontal plane or from the base plate 12). Slope 38 may refer to a ratio in a change in vertical height $VH_2$ from a horizontal plane or from the base plate 12 over a corresponding change in a horizontal position $HP_2$ (e.g., slope 38=$VH_2/HP_2$).

In one or more embodiments, the first flat region 30 may extend upward and outward from the upper ends or the upper regions 26 of the side walls 14 at a slope 38 that ranges between 0 (e.g., at an angle that is 0° or approximately 0° from a horizontal plane or from the base plate 12, or that is 90° or approximately 90° from a vertical plane) and 0.35 (e.g., at an angle that is 20° or approximately 20° from a horizontal plane or from the base plate 12, or that is 70° or approximately 70° from a vertical plane), inclusive. In some examples, the slope 38 can range between 0 (e.g., at an angle that is 0° or approximately 0° from a horizontal plane or from the base plate 12, or that is 90° or approximately 90° from a vertical plane) and 0.1 (e.g., at an angle that is 5° or approximately 5° from a horizontal plane or from the base plate 12, or that is 85° or approximately 85° from a vertical plane), inclusive.

The first flat region 30 may be separated from the upper ends or the upper regions 26 of the side walls 14 by a rounded region or fillet 39. Rounded region or fillet 36 and rounded region or fillet 39 may be concave when viewed from a bottom of the food tray 10. Rounded region or fillet 36 and rounded region or fillet 39 may be convex when viewed from a top of the food tray 10.

The second flat region 32 may extend downward and outward the first flat region 30 at a slope 40 relative to the horizontal or relative to the base plate 12 that is greater than one (e.g., at an angle that is 45° or greater from a horizontal plane). Slope 40 may refer to a ratio in a change in vertical height $VH_3$ from a horizontal plane or from the base plate 12 over a corresponding change in a horizontal position $HP_3$ (e.g., slope 40=$VH_3/HP_3$), with a positive value used for convenience to indicate a negative mathematical slope where a "downward" direction is otherwise specified.

In one or more embodiments, the second flat region 32 may extend downward and outward the first flat region 30 at a slope 40 that ranges between 1.5 (e.g., at an angle that is 55° or approximately 55° from a horizontal plane or from the base plate 12, or that is 35° or approximately 35° from a vertical plane) and 11 (e.g., at an angle that is 85° or approximately 85° from a horizontal plane or from the base plate 12, or that is 5° or approximately 5° from a vertical plane), inclusive. In some examples, the slope 40 can range between 3 (e.g., at an angle that is 75° or approximately 75° from a horizontal plane or from the base plate 12, or that is 15° or approximately 15° from a vertical plane) and 11 (e.g., at an angle that is 85° or approximately 85° from a horizontal plane or from the base plate 12, or that is 5° or approximately 5° from a vertical plane), inclusive. Moving the second flat region 32 outward along slope 40 facilitates loading the second flat region like a spring, which offsets the force applied by the overwrap (e.g., the polyethylene resin or a poly substitute coating), and operates to ease separation of the food tray 10 from the stamping die during the manufacturing process.

The outer rim 28 (including the first flat region 30 and the second flat region 32) may have a horizontal length $H_L$ and a vertical length $V_L$. The horizontal length $H_L$ may be larger than the vertical length $V_L$. A ratio of the horizontal length $H_L$ to the vertical length $V_L$ may range between 1:1 and 10:1. In some examples, the ratio of the horizontal length $H_L$ to the vertical length $V_L$ may range between 2:1 and 5:1. The ratio of the horizontal length $H_L$ to the vertical length $V_L$ may provide a desired aesthetic appearance to the outer rim 28.

The food tray 10 may further include a horizontally extending ledge 42 that extends within the food storage space 22. More specifically, the horizontally extending ledge 42 may be defined along or by inward or inwardly facing surfaces 44 of the side walls 14. The horizontally extending ledge 42 may be positioned radially inward of the outer rim 28 (including the first flat region 30 and the second flat region 32). The horizontally extending ledge 42 may be positioned radially outward of the base plate 12. The horizontally extending ledge 42 may be positioned below the outer rim 28 (including the first flat region 30 and the second flat region 32). The horizontally extending ledge 42 may be positioned above the base plate 12.

The horizontally extending ledge 42 may be substantially parallel with the base plate 12. More specifically, the horizontally extending ledge 42 may be substantially parallel with an upper surface 46 the base plate 12. As used herein, substantially parallel refers to any incremental angle that is between exactly parallel and 15° or less from exactly parallel (e.g., 12.5° or less from exactly parallel, 10° or less from exactly parallel, or 5° or less from exactly parallel).

The food tray 10 may be manufactured or produced via a stamping process. For example, a blank (e.g., a flat sheet of paper board or other desirable material) may be placed into a stamping die. The stamping die may have a corresponding shape that matches the shape of the food tray 10. To ensure separation of the stamping die from the food tray 10 during the retracting of the stamping die after the food tray 10 has been formed, the food tray 10 may include various shapes or geometric features such as beads, changes in direction of along a surface engaging the die, or other features that operate to facilitate separation of the stamping die from the food tray 10. For example, the horizontally extending ledge 42 corresponds to a change in direction along an external surface of the food tray that may operate to facilitate separation of the stamping die from the food tray 10.

As another example, the side walls 14 and the second flat region 32 extend away from each other in opposing directions and in the downward direction extending away from the first flat region 30. This creates an opening or spreading out effect (e.g., a space 48 defined between the side walls 14 and the second flat region 32 increases in the downward direction extending away from the first flat region 30) that may operate to ease separation of the food tray 10 from the stamping die during the manufacturing process. This relationship between the side walls 14 and the second flat region 32 also facilitates loading the second flat region 32 like a spring, which offsets the force applied by the overwrap (e.g., the polyethylene resin or a poly substitute coating).

In one or more embodiments, the combination of $HP_1$, $VH_1$, $HP_2$, $VH_2$, $HP_3$, $VH_3$, $H_L$, and/or $V_L$ form a beneficial flange geometry in one or more embodiments. The overall flange geometry adds structural support to the food tray 10 and/or provides a more consistent edge perimeter. The folding of second flat region 32 at fillet 36 is configured in one or more embodiments to eliminate a sharp edge that may otherwise chafe or cut into plastic (e.g., cellophane) applied to the top of the tray to cover or seal it. Side walls 14 are configured to support the overall geometry of the tray. The angle, length, and/or radius of first flat region 30, second flat region 32, fillet 36, and fillet 39 are selected to reinforce the rigidity of food tray 10.

A lid may also be snapped into place over the flange geometry. In one or more embodiments, the flange geometry accommodates placing a plastic material over the tray without chafing or cutting. Also, the second flat region 32 provides support to the food tray 10 without needing additional support in space 48 (e.g., polymer, adhesive, or foam support). The structure of second flat region 32 permit the sharp cut edge of the paper tray to be turndown so that it does not come into contact with the over wrap.

Referring to FIGS. 6-10, a second embodiment of a food tray 110 and the corresponding structure of the food tray 110 are illustrated. The food tray 110 may be simply referred to as a tray. The food tray 110 may be constructed of a paperboard layer. Paperboard may refer to a fibrous material that can come from fresh, virgin sources, such as, wood, or from recycled wastepaper. Virgin paper may be made from a high content of wood pulp, for example, 90% wood pulp. The thickness of the paperboard layer may be any of the following values or within an inclusive range between any two of the following values: 0.006 inches, 0.012 inches, 0.018 inches, and 0.024 inches.

The inner surface of the food tray 110 may be coated with a polyethylene (PE) resin or a poly substitute. The outer surface of the food tray 110 may be uncoated. The food tray 110 may be sized to contain food (e.g., poultry, beef, fish, produce, etc.). The thickness of the coating layer may be any of the following values or within an inclusive range between any two of the following values: 0.0001 inches, 0.00402 inches, 0.0004 inches, and 0.001 inches.

The food tray 110 may also operate as a food container, and therefore may be referred to as the food container or simply as the container. The food tray 110 may be configured to receive and store items, such as food. The food tray 110 may also be configured to contain and present such items for consumption (e.g., the food tray 110 may have an open top end that contains and/or presents food for transfer onto a plate). The food tray 110 may be configured to engage a cover or lid (not shown), which covers the open top end, when being utilized as a container for storage purposes. Such a cover or lid may be removed to expose the open top end to present the food items for dispensation. The cover or lid may be formed of a clear wrap (E.g., a clear plastic wrap).

The food tray 110 includes a base plate 112. The base plate 112 may be simply referred to as the base. Alternatively, the base plate 112 may be referred to as the base wall or the base panel. The base plate 112 is configured to support food items that are disposed on the food tray 110 along the bottom end of the food tray 10. The food tray 110 includes side walls 114 that extend upward from the base plate 112. The side walls 114 may simply be referred to as the sides. Alternatively, the side walls 114 may be referred to as the side panels. The side walls 114 may extend upward from an outer region or an outer peripheral region 116 of the base plate 112. The side walls 114 may more specifically extend upward from an outer periphery 118 of the base plate 112. The side walls 114 may comprise a single wall that forms a first closed loop 119 that encircles, encompasses, or extends around the base plate 112.

A rounded region or fillet 120 may be positioned between the base plate 112 and the side walls 114. Additional rounded regions or fillets 123 may be positioned between adjacent side walls 114. The rounded regions or fillets 123 may also intersect the rounded region or fillet 120 forming intersecting regions 125. The intersecting regions 125 may taper as they extend down and toward the base plate 112. The rounded regions or fillets 123 may expand as they extend down and toward the intersecting regions 125. Rounded regions or fillets 123 and intersecting regions 125 may be concave when viewed internally within a food storage space 122 defined by the food tray 110. Rounded regions or fillets 123 and the intersecting regions 125 may be convex when viewed externally from an exterior of the food tray 110.

The side walls 114 may extend upward and radially outward from the base plate 112. The base plate 112 may be oriented horizontally and the side walls 114 may extend upward and outward from the base plate 112. More specifically, the side walls 114 may extend upward and outward from the rounded region or fillet 120 having a first radius R1 along arcs 115 or curves having an arc radius $A_1$. In one or more embodiments, the arcs 115 or curves of the side walls 114 may form a section of a circle having the arc radius $A_1$. The arcs 115 or curves of the side walls 114 may be convex when viewed internally within the food storage space 122 defined by the food tray 110. The arcs 115 or curves of the side walls 114 may be concave when viewed externally from an exterior of the food tray 110. The arc radius $A_1$. adds rigidity to the food tray 110 and facilitates a reduction in deflection of the side walls 114 in response to forces acting on the side walls 114.

The base plate 112 may be substantially flat. For example, the base plate 112 may have an allowable tolerance of 2 millimeters (mm) or less, 1 mm or less, or 0.5 mm or less, 0.25 mm or less, etc. from a corresponding perfectly flat plane.

The side walls 114 may be configured to prevent items, such as food items, from slipping or falling off the base plate 112. Stated in other terms, the side walls 114 may be configured to retain items, such as food items, on the base plate 112. The food storage space 122 is defined between the side walls 114 and above the base plate 112. An opening 124 to the food storage space 122 is defined along upper ends or upper regions 126 of the side walls 114. The opening 124 may be covered by a lid (not shown) when the food tray 110 is being utilized as a storage container. The food storage space 122 may more specifically be defined between internal surfaces 127 of the side walls 114 and above the base plate 112. The internal surfaces 127 of the side walls 114 are convex due to the arcs 115 or curves of the side walls 114 (e.g., the arcs 115 or curves of the side walls 114 having an arc radius $A_1$ as illustrated).

The food tray 110 includes an outer rim 128 that extends outward from the side walls 114. The outer rim 128 may be referred to as an overhanging region or an overhang that extends radially outward from the side walls 114. The outer rim 128 may extend radially outward from the upper ends or the upper regions 126 of the side walls 114, relative to a reference axis extending perpendicularly through a centroid of the base plate 112. The outer rim 128 has a first flat region 130 that extends outward from the upper ends or the upper regions 126 of the side walls 114. The outer rim 128 also has a second flat region 132 that extends downward and outward from the first flat region 130 on an opposing side of the first flat region 130 relative to the upper ends or the upper regions 126 of the side walls 114. The outer rim 128 may form a second closed loop 134 that encircles, encompasses, or extends around the side walls 114 and the base plate 112.

The first flat region 130 may comprise a first flat panel extending radially outward from the upper ends or the upper regions 126 of the side walls 114, while the second flat region 132 may comprise a second flat panel extending downward and radially outward from the first flat panel. The first flat panel may be an upper panel and may be substantially flat. The second flat panel may be a side panel and may also be substantially flat. For example, the first and second flat panels comprising the first flat region 130 and the second flat region 132, respectively, may have an allowable tolerance of 2 millimeters (mm) or less, 1 mm or less, or 0.5 mm or less, 0.25 mm or less, etc. from a corresponding perfectly flat plane.

The outer rim 128 may further comprise a rounded region or fillet 136. The first flat region 130 may be separated from the second flat region 132 by the rounded region or fillet 136. Rounded region or fillet 136 may have a radius $R_3$. More specifically, rounded region or fillet 136 may form a section of a circle having radius $R_3$. The first flat region 130 may extend outward from the upper ends or the upper regions 126 of the side walls 114 along a substantially horizontal orientation. Substantially horizontal may refer to any incremental angle that is between exactly horizontal and 5° from exactly horizontal. The first flat region 130 may also be substantially parallel with the base plate 112.

The first flat region 130 may be separated from the upper ends or the upper regions 126 of the side walls 114 by a rounded region or fillet 139. Rounded region or fillet 139 may have a radius $R_2$. More specifically, rounded region or fillet 139 may form a section of a circle having radius $R_2$. Rounded region or fillet 136 and rounded region or fillet 139 may each be concave when viewed from a bottom of the food tray 110. Rounded region or fillet 136 and rounded region or fillet 139 may each be convex when viewed from a top of the food tray 110. As previously stated, the side walls 114 may extend upward and outward from the rounded region or fillet 120 along arcs 115 or curves having a radius $R_1$. Fillet 139 is disposed on an opposite side of the side walls 114 and corresponding arcs 115 relative to fillet 120. Therefore, the side walls 114 and corresponding arcs, having a radius $R_1$, are disposed between, extend between, or sandwiched between fillet 120 and fillet 139.

The second flat region 132 may extend downward and outward the first flat region 130 at a slope 140 relative to the horizontal or relative to the base plate 112 that is greater than one (e.g., at an angle that is 45° or greater from a horizontal plane). Slope 140 may refer to a ratio in a change in vertical height $VH_4$ from a horizontal plane or from the base plate 112 over a corresponding change in a horizontal position $HP_4$ (e.g., slope 140=$VH_4/HP_4$). Slope 140 facilitates loading the second flat region 132 like a spring, which offsets the force applied by the overwrap (e.g., the polyethylene resin or a poly substitute coating) and operates to ease separation of the food tray 110 from the stamping die during the manufacturing process.

In one or more embodiments, the second flat region 132 may extend downward and outward the first flat region 130 at a slope 140 that ranges between 1.5 (e.g., at an angle that is 55° or approximately 55° from a horizontal plane or from the base plate 12, or that is 35° or approximately 35° from a vertical plane) and 11 (e.g., at an angle that is 85° or approximately 85° from a horizontal plane or from the base plate 12, or that is 5° or approximately 5° from a vertical plane), inclusive. In some examples, the slope 140 can range between 3 (e.g., at an angle that is 75° or approximately 75° from a horizontal plane or from the base plate 12, or that is 15° or approximately 15° from a vertical plane) and 11 (e.g., at an angle that is 85° or approximately 85° from a horizontal plane or from the base plate 12, or that is 5° or approximately 5° from a vertical plane), inclusive.

The outer rim 128 (including the first flat region 130 and the second flat region 132) may have a horizontal length $H_{L2}$ and a vertical length $V_{L2}$. A ratio of the horizontal length $H_{L2}$ to the vertical length $V_{L2}$ may range between 1:4 and 10:1, inclusive. In some examples, the ratio of horizontal length $H_{L2}$ to the vertical length $V_{L2}$ may range between 1:2 and 2:1, inclusive.

A ratio of arc radius $A_1$ over radius $R_2(A_1/R_2)$ is greater than one. In one or more embodiments, the ratio of radius $A_1$ over radius $R_2$ ($A_1/R_2$) may range between 4 and 20. Such a ratio ($A_1/R_2$) facilitates a gradual opening of the side wall 114 along the top of the food tray 110 while also facilitating a quicker transition or a sharper transition from the side walls 114 to the first flat region 130 of the outer rim 128. The transition between radius $A_1$ and radius $R_2$ is designed to be as subtle as possible so that a hinge point is not created. Such a hinge point would facilitate a non-desired increase in deflection when a force is applied to the second flat region of 132.

A ratio of radius $R_3$ over radius $R_2$ ($R_3/R_2$) is less than one. In one or more embodiments, the ratio of radius $R_3$ over radius $R_2$ ($R_3/R_2$) may range between 0.1 and 1, inclusive. In some examples the ratio of radius $R_3$ over radius $R_2$ ($R_3/R_2$) may range between 0.5 and 1. Such a ratio $R_2$ ($R_3/R_2$) facilitates a transition from the first flat region 130 of the outer rim 128 to the second flat region 132 of the outer rim 128 that is sufficiently quick or sharp but not as quick or sharp as transition from the side walls 114 to the first flat region 130 of the outer rim 128. This arrangement can help to ensure that the upper edge of the outer rim 128 (e.g., the outward facing convex surface along fillet 139), which is more likely to come into contact with a user, is more rounded and less sharp than the outward facing convex surface along fillet 136 where a sharper transition from the side walls 114 to the first flat region 130 may be desirable. The sharper transition allows the second flat region of 132 to be closer to perpendicular relative to the first flat region 130. Decreasing radius $R_3$ reduces stress and potential unwanted deformation of the food tray during manufacturing.

The food tray 110 may be manufactured or produced via a stamping process. For example, a blank (e.g., a flat sheet of paper board or other desirable material) may be placed into a stamping die. The stamping die may have a corresponding shape that matches the shape of the food tray 110. To ensure separation of the stamping die from the food tray 110 during the retracting of the stamping die after the food tray 110 has been formed, the food tray 110 may include various shapes or geometric features such as beads, changes in direction of along a surface engaging the die, or other features that operate to facilitate separation of the stamping die from the food tray 110.

For example, the side walls 114 and the second flat region 132 extend away from each other in opposing directions and in the downward direction extending away from the first flat region 130. This creates an opening or spreading out effect (e.g., a space 148 defined between the side walls 114 and the second flat region 132 increases in the downward direction extending away from the first flat region 130) that may operate to facilitate separation of the stamping die from the food tray 110.

In one or more embodiments, the combination of $HP_4$, $VH_4$, $A_1$, $R_2$, $R_3$, $H_{L2}$, and/or $V_{L2}$ form a beneficial flange geometry in one or more embodiments. The overall flange geometry adds structural support to the food tray 110 and/or provides a more consistent edge perimeter. The folding of second flat region 132 at fillet 136 is configured in one or more embodiments to eliminate a sharp edge that may otherwise chafe or cut into plastic (e.g., cellophane) applied to the top of the tray to cover or seal it.

A lid may also be snapped into place over the flange geometry. In one or more embodiments, the flange geometry accommodates placing a plastic material over the tray without chafing or cutting. Also, the second flat region 132 provides support to the food tray 110 without needing additional support in space 148 (e.g., polymer, adhesive, or foam support). The distance between the side walls 114 and second flat region 132 within space 148 is minimized without compromising the benefits of the relationship between arc radius $A_1$ and radius $R_2$. Horizontal length $H_{L2}$ and the space 148 are design to be as short as possible so that torsional loads are minimized without compromising the benefits of the relationship between arc radius $A_1$ and radius $R_2$.

Figure 11:
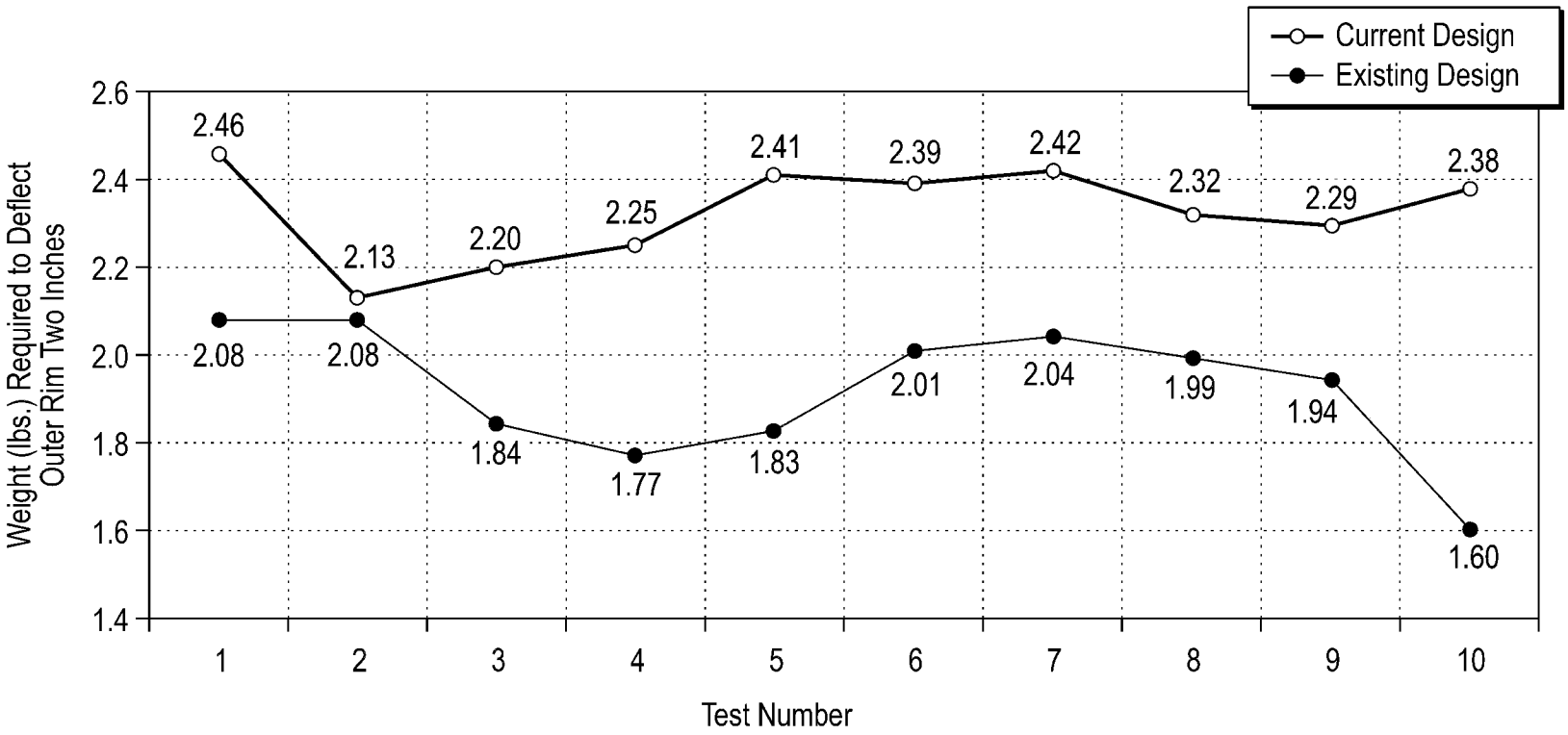
FIG. 11 is a chart comparing the ability of the second embodiment of the food tray to withstand an applied force relative to the ability of an existing design to withstand an applied force.

Referring to FIG. 11, a chart that compares the ability of the second embodiment of the food tray 110 (labelled as "Current Design") to withstand an applied force relative to the ability of an existing design (labelled as "Existing Design") to withstand an applied force is illustrated. Several tests were conducted on the current design and the existing design. Each test included applying a downward force along the outer rim of the current design (outer rim 128) and the outer rim of the existing design. In total, ten tests were conducted on both the current design and the existing design. The tests are labelled as test numbers 1-10 on the X-axis.

The Y-axis depicts the force (lbs.) that was applied during each test that resulting in deflecting the outer rim of the current design and the outer rim of the existing design a distance of two inches. The values of the forces that resulted in deflecting outer rim of the current design two inches are greater than the values of the forces that resulted in deflecting outer rim of the existing design two inches. The forces required to deflect the outer rim of the current design ranged between 2.13 and 2.46 lbs. over the ten tests with an average force of 2.33 lbs. The forces required to deflect the outer rim of the existing design ranged between 1.60 and 2.08 lbs. over the ten tests with an average force of 1.92 lbs. These results indicate that a larger force is required to deflect the outer rim of the current design relative the force required to deflect the outer rim of the existing design. This further indicates that the ability of the current design to withstand an applied force is greater than the ability of the existing design to withstand an applied force.

It should be understood that the designations of first, second, third, fourth, etc. for any component, state, or condition described herein may be rearranged in the claims so that they are in chronological order with respect to the claims. Furthermore, it should be understood that any component, state, or condition described herein that does not have a numerical designation may be given a designation of first, second, third, fourth, etc. in the claims if one or more of the specific component, state, or condition are claimed.

The detailed description set forth herein includes several embodiments where each of the embodiments may include several components, features, and/or steps. For the avoidance of doubt, any component, feature, and/or step of one embodiment may be applied, mixed, substituted, matched, and/or combined with one or more components, features, and/or steps of other embodiments. Such resulting embodiments are expressly within the scope of this disclosure.

The words used in the specification are words of description rather than limitation, and it is understood that various changes may be made without departing from the spirit and scope of the disclosure. While various embodiments could have been described as providing advantages or being preferred over other embodiments or prior art implementations with respect to one or more desired characteristics, those of ordinary skill in the art recognize that one or more features or characteristics may be compromised to achieve desired overall system attributes, which depend on the specific application and implementation. As such, embodiments described as less desirable than other embodiments or prior art implementations with respect to one or more characteristics are not outside the scope of the disclosure and may be desirable for particular applications.

What is claimed is:

1. A food tray comprising:
a base wall;
a side wall;
a first flat region extending outward from the side wall; and
a second flat region extending downward from the first flat region;
wherein:
a first fillet having a first radius is defined between and connects the base wall and the side wall;
a second fillet having a second radius is defined between and connects the side wall and the first flat region;
a third fillet having a third radius is defined between and connects the first flat region and the second flat region;
the second flat region extends downward from the first flat region at an angle between approximately 75 degrees and approximately 85 degrees; and
the base wall, the first fillet, the side wall, the second fillet, the first flat region, the third fillet, and the second flat region are formed from paper board.

2. The food tray of claim 1, wherein the first flat region is substantially parallel to the base wall.

3. The food tray of claim 1, wherein the side wall extends along an arc between the first fillet and the second fillet, the arc being convex toward a food storage area of the food tray.

4. The food tray of claim 3, wherein the first flat region is substantially horizontal.

5. The food tray of claim 4, wherein a first ratio of the third radius to the second radius is less than 1.

6. The food tray of claim 5, wherein the arc has an arc radius and a second ratio of the arc radius to the second radius is between 4 and 20.

7. The food tray of claim 1, wherein a first ratio of the third radius to the second radius is between 0.1 and 1.

8. A food tray comprising:
a base wall;
a side wall;
a first rim region extending outward from the side wall; and
a second rim region extending from the first rim region;
wherein:
a first fillet having a first radius extends between the base wall and the side wall;
a second fillet having a second radius extends between the side wall and the first rim region;
a third fillet having a third radius extends between the first rim region and the second rim region;
the side wall extends along an arc between the first fillet and the second fillet, the arc being convex toward a food storage area of the food tray; and
the base wall, the first fillet, the side wall, the second fillet, the first rim region, the third fillet, and the second rim region are formed from paper board.

9. The food tray of claim 8, wherein the first rim region and the second rim region are flat.

10. The food tray of claim 9, wherein the first rim region is substantially horizontal.

11. The food tray of claim 10, wherein the arc of the side wall transitions smoothly from the base wall via the first fillet to the first rim region via the second fillet and wherein the first rim region transitions smoothly to the second rim region via the third fillet.

12. The food tray of claim 8, wherein the third radius is less than the second radius.

13. The food tray of claim 12, wherein the arc has an arc radius and the arc radius is greater than the second radius.

14. The food tray of claim 8, wherein the second rim region extends from the first rim region at an angle that is between approximately 5 degrees and approximately 15 degrees from a vertical plane.

15. A food tray comprising:
a base wall;
a side wall extending up and out away from the base wall, wherein a first fillet having a first radius connects the base wall to a bottom portion of the side wall, the side wall extends up and out from the first fillet along an arc having an arc radius, and the arc is convex toward a food storage area of the food tray;
a first flat region extending out away from the side wall, wherein the first flat region is substantially horizontal, a second fillet having a second radius connects a first end of the first flat region to the arc of the side wall at a top portion of the side wall, so that the arc of the side wall connects the first fillet to the second fillet; and a second flat region extending down and out away from the first flat region, wherein a third fillet having a third radius connects a second end of the first flat region to the second flat region, and the base wall, the first fillet, the side wall, the second fillet, the first flat region, the third fillet, and the second flat region are formed from paper board.

16. The food tray of claim 15, wherein the second flat region extends from the first flat region at an angle that is between approximately 5 degrees and approximately 15 degrees from a vertical plane.

17. The food tray of claim 16, wherein the first flat region is substantially horizontal.

18. The food tray of claim 17, wherein the third radius is less than the second radius.

19. The food tray of claim 15, wherein the third radius is less than the second radius.

20. The food tray of claim 15, wherein the arc of the side wall transitions smoothly from the first fillet to the second fillet.

* * * * *